US006871404B2

(12) United States Patent
Cook et al.

(10) Patent No.: US 6,871,404 B2
(45) Date of Patent: Mar. 29, 2005

(54) RAG QUILT SEAM GAUGE AND TABLE GUARD

(76) Inventors: Frank M. Cook, 2859 N. Kashmir, Mesa, AZ (US) 85215; Dayle M. Cook, 2859 N. Kashmir, Mesa, AZ (US) 85215

( * ) Notice: Subject to any disclaimer, the term of this patent is extended or adjusted under 35 U.S.C. 154(b) by 0 days.

(21) Appl. No.: 10/404,533

(22) Filed: Apr. 2, 2003

(65) Prior Publication Data

US 2004/0194319 A1 Oct. 7, 2004

(51) Int. Cl.[7] ..... B26B 13/00
(52) U.S. Cl. ..... 30/233; 30/179
(58) Field of Search ..... 30/233, 179, 294, 30/290, 293, 276

(56) References Cited

U.S. PATENT DOCUMENTS 1,279,389 A 9/1918 Malsin
4,235,016 A 11/1980 Kobelt
5,048,187 A * 9/1991 Ryan ..... 30/276
5,379,521 A 1/1995 Lynders
6,038,772 A 3/2000 Cornell et al.
6,308,421 B1 * 10/2001 Wang ..... 30/178
6,317,987 B1 11/2001 Joung

FOREIGN PATENT DOCUMENTS

GB 529266 11/1940
JP 10-117592 5/1998

* cited by examiner

*Primary Examiner*—Douglas D Watts
(74) *Attorney, Agent, or Firm*—Richard C. Litman

(57) ABSTRACT

The seam gauge and table guard attachment attaches to a pair of conventional scissors. The protective guard includes a rigid, unitary U-shaped frame with a rectangular base portion and an inclined cover portion. The inclined cover portion has a plurality of fastener holes for receiving a fastener. A fastener is provided for engaging the fastener holes to secure the protective guard to the conventional scissors. The inclined cover portion is positioned over the stationary blade and the protective guard is secured to the scissors by the fastener. The rectangular base portion is disposed below the cutting blade to prevent the scissors from cutting beyond a specific point. The protective guard allows a user to clip the seam allowance on a rag quilt without cutting through and damaging the seam of a rag quilt.

4 Claims, 4 Drawing Sheets

RAG QUILT SEAM GAUGE AND TABLE GUARD

BACKGROUND OF THE INVENTION

1. Field of the Invention

The present invention relates to preventative guard attachments for scissors, and more particularly to a guard for scissors that protects the seam of a rag quilt while clipping the seam.

2. Description of the Related Art

Rag quilts have become increasingly popular with people who enjoy sewing. The final step in making a rag quilt is to clip the seam allowance of the rag quilt to make the seam ragged. This last step is often time consuming because the quilt designer must make any necessary repairs to the rag quilt if the seam is cut. It is difficult to make the rag cuts on the rag quilt without cutting too far and damaging the seams of the rag quilt. Conventional scissors do not provide any means for preventing the scissors from cutting into the fabric.

Conventional scissors also often damage the table or workstation that a person is cutting material on. While someone is cutting a piece of material, the bottom blade of the scissors may come into contact with the scissors and scratch or otherwise damage the top of the table or workstation.

The following patent documents disclose examples of existing scissor guards that are designed to limit the cutting of conventional scissors.

U.S. Pat. No. 1,279,389 to Malsin discloses safety scissors for preventing damage to delicate fabrics while trimming their edges. The safety guard extends below the blades and shields the fabric around the edge. Only the edge of the fabric that is being trimmed is in contact with the scissor blades.

U.S. Pat. No. 4,235,016 to Kobelt discloses safety scissors with a guard member secured to the pivot point of the scissors. The guard member has a slot that only allows material that is as thin as a sheet of paper to enter through the guard and into contact with the scissor blades. A stop is provided for preventing the pair of scissor blades from opening too wide and leaving one of the scissor blades exposed.

U.S. Pat. No. 5,379,521 to Lynders discloses safety scissors. The scissors include a U-shaped shield that prevents direct contact by the user with the cutting edge of the scissor blades. A flat shield is attached to the outer surface of one blade and extends beyond the cutting edge and tip of the cutting blade. An elongated U-shaped shield is attached to the outer surface of the other blade.

U.S. Pat. No. 6,038,772 to Cornell et al. discloses edging scissors equipped with guide members. The guide members control the angular presentation of paper to the blades of the scissors to limit the amount of paper presented to the blades. The guides include a bottom plate and a cover plate having a strip extending between a pair of posts attached to the bottom plate. The strip forms a slot between the two plates.

U.S. Pat. No. 6,317,987 to Joung discloses scissors with a pair of safety plates for separating fabric from the pair of scissor blades. The safety plates are secured to the sides of the bottom cutting blade. The safety plates separate the cutting blades from the fabric a certain distance while cutting waste portions from the fabric. The safety plates prevent the cutting blades from contacting the fabric.

United Kingdom Provisional Specification No. 529,266 to Sellers et al. discloses improved scissors for cutting delicate fabrics. An adjustable sheath or guide plate is attached to the scissors to protect the fabric. The sheath is fixed to the underside of the lower blade of the scissors and rests on the fabric as the splicing threads are severed. The sheath has a funnel shaped end that fits over the scissor blade and a thin flat plate that extends along the bottom of the blade. A screw is provided to fix the sheath in its desired position.

Japanese Patent No. 10-117592 to Kawano discloses a stopper mechanism for limiting the opening of scissor blades. The stopper mechanism can be adjusted to allow for at least two opening distances.

None of the above inventions and patents, or other existing scissors, provide a protective guard that prevents scissor blades from damaging rag quilt seams while clipping the seam allowance. Also, none of the above inventions and patents provide a protective guard that prevents scissor blades from damaging a cutting surface located underneath material that is being cut with the scissors. Therefore what is needed is a protective guard that may be attached to conventional scissors to prevent damage to the seam of a rag quilt while clipping the seam allowance. What is further needed is a protective guard attachment that may be attached to conventional scissors to minimize the amount of repair that must be done after the seam allowance is clipped so it looks ragged. What is still further needed is a protective guard that may be made in varying sizes to easily attach to any conventional pair of scissors to protect the cutting surface from damage.

None of the above inventions and patents, taken either singly or in combination, is seen to describe the instant invention as claimed. Thus a scissor attachment solving the aforementioned problems is desired.

SUMMARY OF THE INVENTION

The present invention is a guard attachment for scissors meeting some or all of the industry needs mentioned above. The guard attachment prevents damage to the seam of a rag quilt while clipping the seam allowance of the rag quilt. The guard attachment may also be attached to a pair of scissors to protect the work surface where the scissors are being used. The guard attachment may be attached to any conventional scissors. Typical conventional scissors include a stationary blade, a cutting blade, and two handles. One of the handles is attached to a non-cutting end of the stationary blade and the other handle is attached to a non-cutting end of the cutting blade.

The protective guard attachment includes a rigid, unitary U-shaped frame with a rectangular base portion and an inclined cover portion. The inclined cover portion has a plurality of fastener holes for receiving a fastener. A fastener is provided for engaging the fastener holes to secure the protective guard attachment to the conventional scissors. Alternatively, the protective guard attachment may be clamped onto the scissors without the need for a fastener. The inclined cover portion is positioned over the stationary blade and the protective guard is secured to the scissors by the fastener. The rectangular base portion is disposed below the cutting blade to prevent the scissors from cutting beyond a specific point.

In use, the base portion of the protective guard is positioned on the surface or material that is to be protected. The protective guard separates the material to be cut from the material or surface that is to be protected. The material to be cut passes past the protective guard into the allowed cutting range of the scissor blades. The scissor blades then sever the material to be cut but are prevented from cutting the material or surface to be protected. When the scissor blades reach the limit of the allowed cutting range the protective guard stops the cutting blade from contacting the seam or surface to be protected.

The present protective guard is made in varying sizes to accommodate any size conventional scissors. The preferred embodiment of the present invention provides a protective guard that is adapted to fit to conventional scissor to modify the scissors to be used as rag quilt scissors to clip the seam allowance of a rag quilt. The protective guard allows a user to clip the seam allowance of a rag quilt without cutting through and damaging the seam of a rag quilt.

Accordingly, it is a principal object of the invention to provide a protective guard that may be attached to conventional scissors to prevent damage to the seam of the quilt while clipping the seam allowance.

It is another object of the invention to provide a protective guard attachment that may be attached to conventional scissors to minimize the amount of repair that must be done after the seam allowance is clipped.

It is a further object of the invention to provide a protective guard that may be made in varying sizes to easily attach to any conventional pair of scissors that protects a cutting surface from scratching or other damage while cutting any material.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
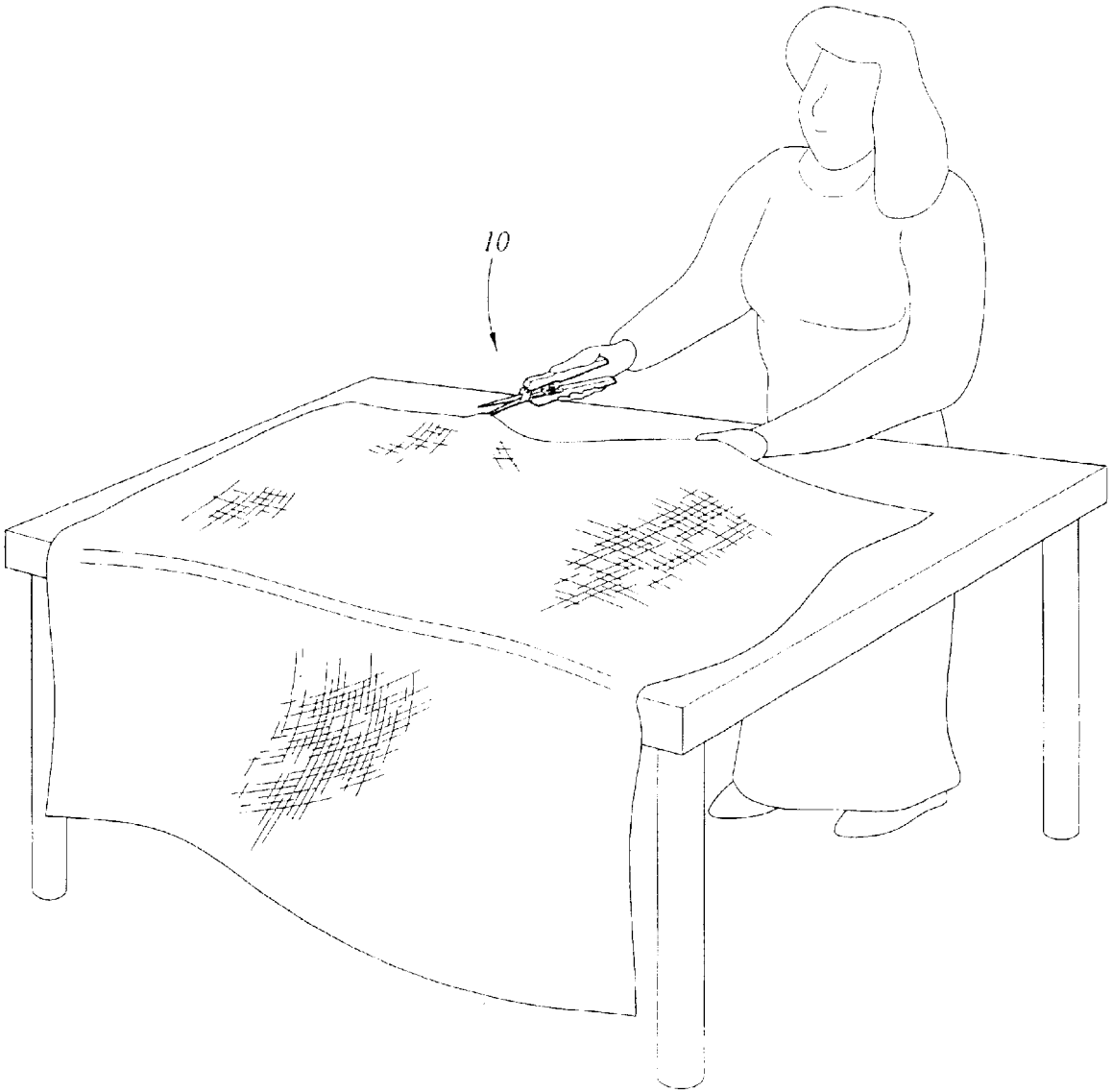
FIG. 1 is an environmental., perspective view of a scissor with a guard attachment according to the present invention.

The present invention is a protective guard attachment for conventional scissors. According to the preferred embodiment of the present invention, a protective guard is attached to a conventional scissor for clipping the seam allowance of a rag quilt. The present invention is not limited to being used with scissors for clipping rag quilt seams, and the protective guard may be used with any type of conventional scissor for cutting any type of material. The protective guard may be used to protect the surface of a workstation from damage caused by the blades of scissors. FIG. 1 depicts scissors with a protective guard attachment 10 being used to cut material on a workstation.

Figure 2:
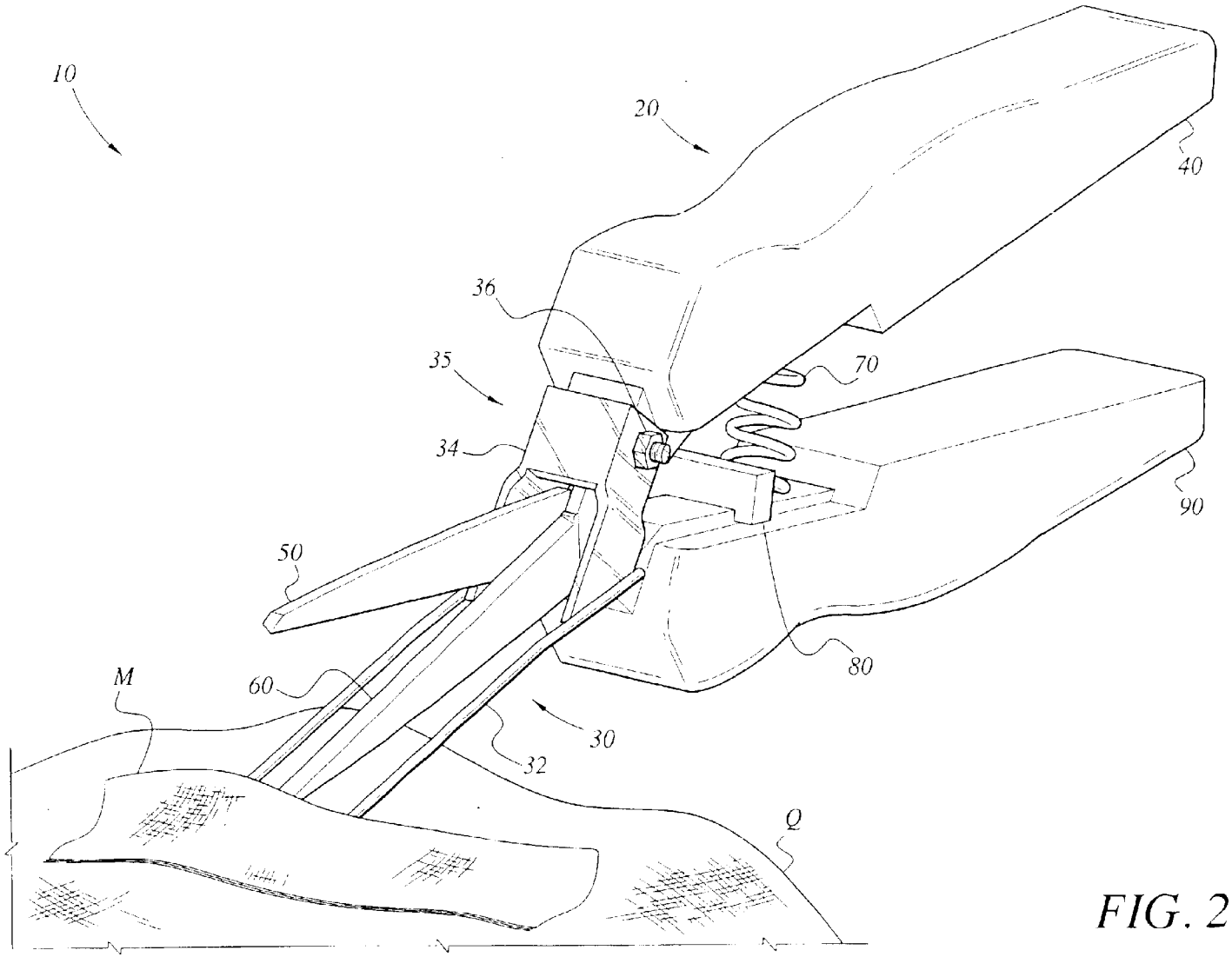
FIG. 2 is a perspective view a first embodiment of a scissor with a guard attachment.

FIG. 2 depicts a perspective view of the scissors with a protective guard attachment 10 according to the preferred embodiment of the present invention. The scissors with a protective guard attachment 10 comprise conventional scissors 20 and a protective guard attachment 30. The rag quilt scissors 20 further comprise a stationary blade 50, a cutting blade 60, a first handle 40, a second handle 90, a compression spring 70 and a locking mechanism 80.

The first handle 40 is attached to the non-cutting end of the cutting blade 60. The second handle 90 is attached to the non-cutting end of the stationary blade 50. The compression spring 70 is attached at a first end to the first handle 40 and at a second end to the second handle 90.

Figure 3:
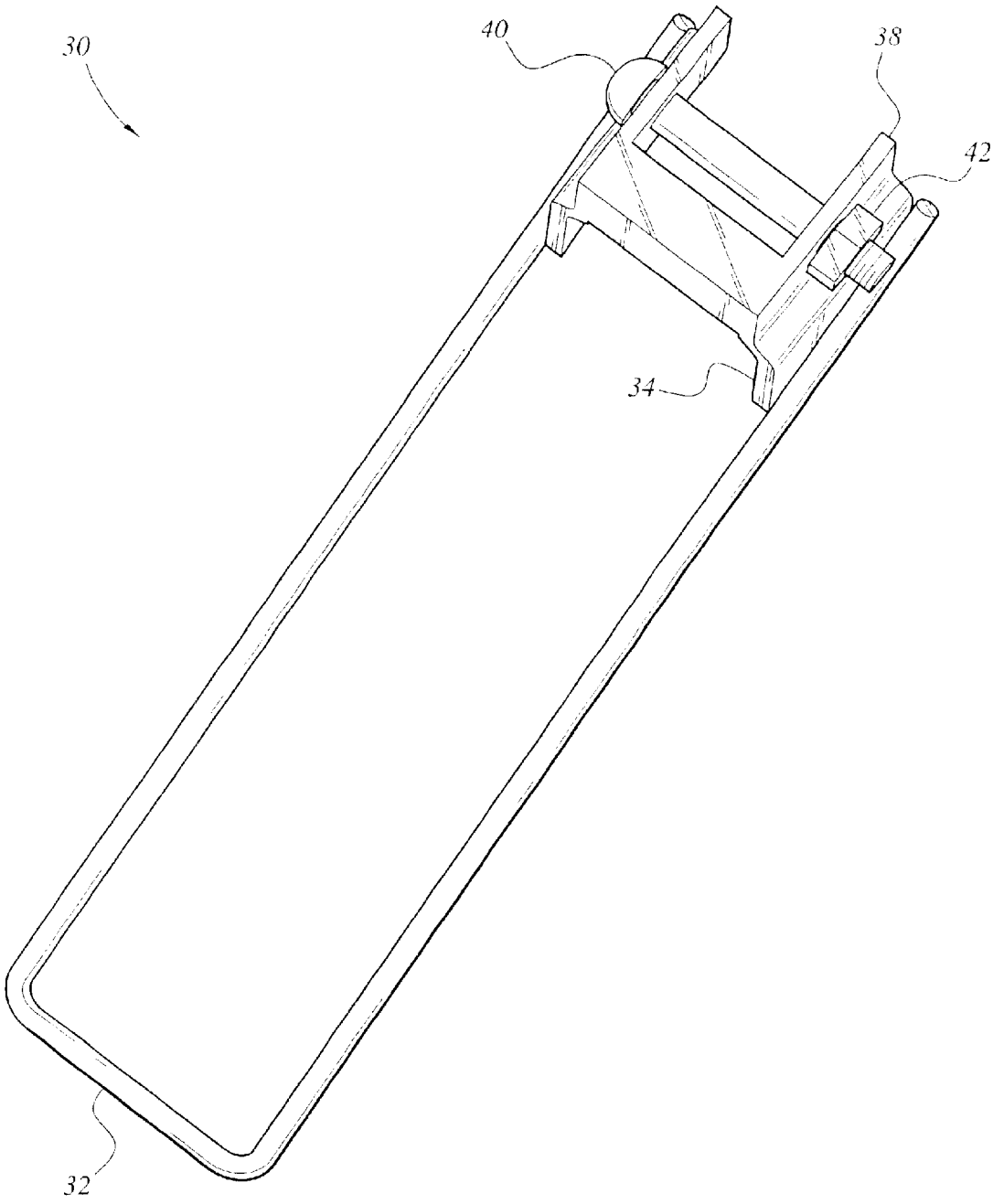
FIG. 3 is a perspective view of a guard attachment for a scissor.

FIG. 3 is a perspective view of the protective guard attachment 30. The protective guard 30 is generally U-shaped. The protective guard attachment 30 comprises a base portion 32 and an inclined cover portion 34. The base portion 32 is preferably a thin, rigid generally rectangular frame with an open center, but is not limited to this shape. The inclined cover portion 34 further comprises a mounting portion 38. The mounting portion 38 includes a plurality of fastener receiving holes 36. The fastener receiving holes 36 are adapted to receive a fastener 40. The fastener 40 is preferably a threaded fastener that is secured in place by a securing nut 42.

Referring to FIG. 2, the protective guard 30 is placed over the stationary blade 50. The inclined cover portion 34 rests across the front of the handles 40, 90. The base portion 32 is positioned along the bottom of the cutting blade 60. To secure the guard attachment 30 to the scissors 20 a hole must be drilled through the shoulder 35 of the scissors 20. The fastener 40 passes through the fastener receiving holes 36 and then through the hole drilled through the shoulder 35 of the scissors 20. The guard attachment 30 is not limited to being attached to the scissors 20 in this manner, and may be attached by any suitable means. The guard attachment 30 may be designed to snap-fit onto the scissors 20. The fastener 40 allows the protective guard attachment 30 to be removed when necessary. It is necessary to remove the protective guard attachment to cut the seam allowance at the corners.

The rag quilt scissor with a protective guard attachment 10 is preferably used to clip the seam allowance material M of a rag quilt Q. In use, the base portion 32 of the protective guard 30 is positioned under the seam allowance material M of the rag quilt Q. The protective guard 30 separates the seam allowance material M to be clipped and the rag quilt Q that is to be protected. The seam allowance material M passes past the protective guard 30 into the allowed cutting range of the scissor blades 50, 60. The scissor blades 50,60 then clip the seam allowance material M in consecutive cuts but are prevented from cutting the seam of the rag quilt Q. When the scissor blades 50,60 reach the limit of the allowed cutting range the protective guard 30 stops the cutting blade 60 from contacting the rag quilt Q.

Figure 4:
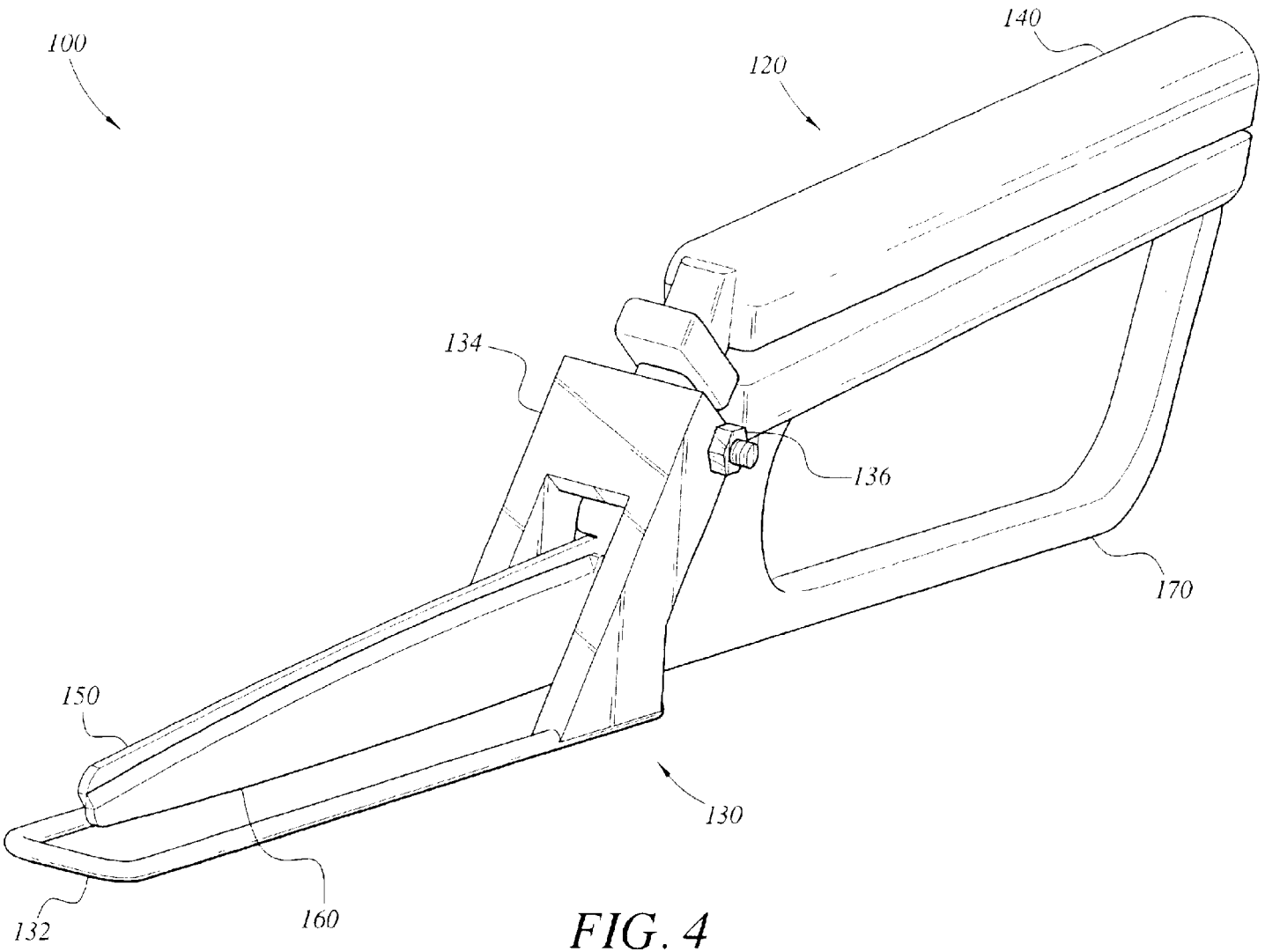
FIG. 4 is a perspective view of a second embodiment of a scissor with a guard attachment.

FIG. 4 depicts a second embodiment of the scissors with a protective guard attachment 100. The scissors with a protective guard attachment 100 comprise fabric scissors 120 and a guard attachment 130. The scissors further comprise a first handle 140, attached to a cutting blade 160, and a second handle 170 attached to a stationary blade 150. The protective guard attachment 130 in the present embodiment comprises generally the same elements as discussed in reference to the first embodiment. The protective guard attachment 130 is generally U-shaped. The protective guard attachment 130 comprises a base portion 132 and an inclined cover portion 134. The base portion 132 is preferably a thin, rigid generally rectangular frame with an open center, but is not limited to this shape. The guard attachment 130 in the present invention is larger than the guard attachment 30 of the first embodiment. The fabric scissors 120 are used when cutting any piece of material on a workstation or table surface. The larger guard attachment 130 is necessary to prevent the larger cutting blade 160 from coming into contact with and damaging the cutting surface underneath the material that is being cut.

The protective guard attachment 30 may be made from any material that is suitably rigid to prevent the cutting blade 60 from cutting beyond a specific point. Preferred embodiments of the present invention are made from metal. The protective guard attachment 30 may be made in varying sizes to fit any size of conventional scissors. The protective guard 30 may be pre-fastened to new scissors or may be made as an attachment to be secured to existing scissors.

It is to be understood that the present invention is not limited to the embodiments described above, but encompasses any and all embodiments within the scope of the following claims.

We claim:

1. A scissor with guard attachment, comprising:

scissors, said scissors include a first blade and a first handle attached thereto, and a second blade and a second handle attached thereto, said first handle and said second handle being pivotally attached, so that movement of said first handle relative to said second handle provides, reciprocal movement of said first blade relative to said second blade, thereby allowing said first and second blades to perform a cutting operation;

a rigid, unitary U-shaped scissor guard with a rectangular base portion and an inclined portion, said inclined portion including a fastener for fastening said U-shaped guard to said scissors;

whereby said inclined portion is positioned over said first blade and said U-shaped scissor guard is secured to said scissors by said fastener and said rectangular base portion is disposed below said second blade of said scissors to prevent said scissors from cutting beyond a range defined by said U-shaped guard.

2. The scissor with guard attachment according to claim 1, wherein said rectangular base portion includes a rectangular exterior frame defining a center opening.

3. The scissor with guard attachment according to claim 1, wherein said U-shaped guard is made from a rigid material, and is designed and configured to prevent said scissors from cutting beyond a range defined by said U-shaped guard.

4. The scissor with guard attachment according to claim 3, wherein said U-shaped guard is made from a metal.

* * * * *